United States Patent [19]

Honjo et al.

[11] 4,043,052

[45] Aug. 23, 1977

[54] METHOD AND APPARATUS FOR FIXING TONER IMAGES

[75] Inventors: Satoru Honjo; Osamu Fukushima, both of Tokyo, Japan

[73] Assignee: Xerox Corporation, Stamford, Conn.

[21] Appl. No.: 633,897

[22] Filed: Nov. 20, 1975

Related U.S. Application Data

[62] Division of Ser. No. 344,383, March 5, 1973, Pat. No. 3,942,266.

[51] Int. Cl.[2] ..... F26B 11/02

[52] U.S. Cl. ..... 34/122; 34/37; 34/155; 96/1 SD; 96/1 LY

[58] Field of Search ..... 34/23, 33, 36, 37, 151, 34/155; 96/1 SD, 1 LY; 432/59

[56] References Cited

U.S. PATENT DOCUMENTS

| | | | |
|---|---|---|---|
| 3,078,589 | 2/1963 | Carlson | 34/155 |
| 3,093,068 | 6/1963 | Gundlach et al. | 34/37 |
| 3,132,047 | 5/1964 | Van Dorn | 34/155 |
| 3,149,931 | 9/1964 | Gundlach | 34/155 |
| 3,158,509 | 11/1964 | Hudson | 34/155 |
| 3,288,624 | 11/1966 | Clark | 96/1 SD |
| 3,560,204 | 2/1971 | Damm | 98/1 LY |
| 3,561,130 | 2/1971 | Galitz | 34/23 |
| 3,659,348 | 5/1972 | Frank | 34/122 |
| 3,704,524 | 12/1972 | Kamola | 34/37 |
| 3,776,723 | 12/1973 | Royka et al. | 96/1 LY |

*Primary Examiner*—John J. Camby
*Assistant Examiner*—Henry C. Yuen
*Attorney, Agent, or Firm*—J. J. Ralabate

[57] ABSTRACT

A toner image carried upon a substrate is fixed by placing the toner image in close juxtaposition to an absorbent web carrying a volatile toner solvent. The toner particles are softened and caused to adhere to the substrate by the action of the vapors emanating from said web. In order to protect the environs from the solvent vapors, the web is enclosed within a substantially sealed housing when laden with said solvent.

4 Claims, 7 Drawing Figures

METHOD AND APPARATUS FOR FIXING TONER IMAGES

This is a division of application Ser. No. 344,383, filed Mar. 5, 1973, now U.S. Pat. No. 3,942,266.

BACKGROUND AND SUMMARY OF THE INVENTION

The present invention relates to fixing toner images such as are produced by electrophotographic and other electrostatic processes. More particularly, the present invention is directed to solvent vapor fixing of toner images, wherein the toner image is placed in close juxtaposition to an absorbent web having a volatile liquid solvent absorbed thereon, and the toner image is fixed upon a substrate by the action of the solvent vapors emanating from said web.

In one conventional electrophotographic process, a photoconductive electrically insulating layer backed with an electrical conducting substrate is uniformly electrostatically pre-charged by any suitable means, such as by corona discharge, and then is exposed to a light image to form an electrostatic latent image. The electrostatic latent image is converted to a visible image by causing fine toner particles to adhere electrostatically to the latent image in accordance with the charge pattern. The toner image thus formed may then be transferred to and fixed upon a transfer sheet, or it may be fixed directly on the photoresponsive layer. In another electrostatic process, the toner images are obtained through a substantially similar process, except that the formation of the electrostatic latent image is effected through such means as corona discharge from selective or patterned electrodes to a dielectric sheet or web.

According to the present invention, the toner image is fixed to a substrate by being placed in closely spaced juxtaposition to a porous absorbent web having a volatile liquid toner solvent absorbed thereon. Suitable solvents for this purpose for use with most commercial toners are the non-combustible chlorinated hydrocarbons. The vapors of said solvent soften the toner particles and thereby cause the toner image to become affixed to its substrate. Because the toner image is held in close proximity to the fixing solvent absorbed on the web, the toner image is subjected to a high concentration of fixing agent vapor, thereby causing the image to be fixed in a very short period of time. The present invention also makes effective use of housing means for the solvent laden web prior to, after and/or during the fixing operation, thereby minimizing or substantially eliminating the dispersion of the solvent vapor into the environs, and avoiding the health hazards attendant the inhalation of most solvent vapors.

It is therefore one object of the present invention to provide for fixing toner images by placing the toner image in closely spaced proximity to an absorbent web having a volatile liquid toner solvent absorbed thereon, whereby the toner image is fixed by the solvent vapors emanating from said web.

A further object of the present invention is to provide for such solvent vapor fixing a toner image, while containing said web within a housing to minimize dispersion of solvent vapor into the environs.

Still another object of the present invention is to provide for such solvent vapor fixing of toner images either intermittently or continuously over an extended and indefinite period of time.

Other objects and advantages of the present invention will become apparent from the detailed description given hereinafter. It is understood, however, that the detailed description and specific examples, while indicating preferred embodiments of the invention, are presented for illustration only, and various changes and modifications within the spirit and scope of the invention will become apparent to those skilled in the art.

BRIEF DESCRIPTION OF THE DRAWINGS

The detailed description of the invention given hereinbelow is had in conjunction with the accompanying drawings, in which like numerals refer to the same or corresponding parts, and wherein.

DETAILED DESCRIPTION

Figure 1:
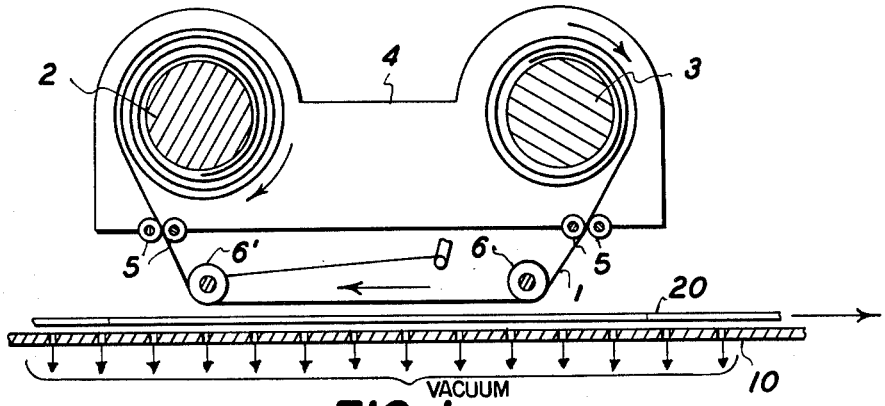
FIG. 1 is a schematic illustration of one embodiment of the present invention, wherein an absorbent web is prewetted with a volatile solvent and is fed from a supply roll to a receiving roll, and wherein both the supply roll and the receiving roll are enclosed in a housing.

The apparatus for solvent vapor fixing of toner images according to the embodiment of FIG. 1 of the present invention, comprises a web 1 formed of absorbent material that is prewetted with a fixing solvent. The web is conveyed over a predetermined path from a supply roll 3, used for storing a supply of prewetted web material, to a take up roll 2 for receiving said web after it has traversed said path. The supply roll and receiving roll are both located in a housing 4, and during the fixing operation the prewetted web is removed from the supply roll and the housing, guided over the predetermined path through the use of rotating guide rollers 6 and 6', and reintroduced into housing 4 where the web is received by roll 2. While the web is being conveyed over said predetermined path outside of the housing 4, a substrate 20 containing the toner image to be fixed is placed in closely spaced juxtaposition to the absorbent web, and the vapors emanating from the volatile liquid solvent absorbed in the web act as a fixing agent for the toner image. The toner image is retained in its closely spaced relationship with the web for a sufficient length of time to insure fixing of the toner image. The substrate containing the toner image to be fixed may be conveyed on the surface of a porous conveyor belt 10, and advantageously the conveyer belt 10 can be provided with a vacuum means for holding the toner substrate thereon. The openings where the web material 1 is removed from and reintroduced into said housing 4 are closed by suitable seals 5 made of a resilient material, and which bear against the web material.

When the web 1 is closely juxtaposed with the toner image, it is important to prevent the web from sagging and contacting the image. Accordingly, a brake is associated with the supply roll 3 so that the web can be maintained in a taut condition.

The porous web 1 may be made of woven or nonwoven natural or synthetic fibers, and it may be reinforced, if necessary, with a suitable backing to provide mechanical strength suitable for the operating conditions. The web is preferably thin, but should have a thickness sufficient to retain the necessary quantity of fixing solvent, and may for example be about 50 microns thick. It should carry a sufficient quantity of fixing solvent to ensure adequate fixing of the toner image, but at the same time an excessive amount of solvent should be avoided so that the solvent will not drip off the web onto the toner image.

The web 1 is driven in the direction of the arrow, and the substrate 20 containing the toner image is driven in the opposite direction. In the case where the toner image is readily fixed, the speed of the fixing web 1 can be less than that of the substrate containing the toner image. However, if the toner image is more difficult to fix, or if a longer fixing time is required, the speed of the fixing web may be increased to expose the toner image to a larger quantity of web wetted with fresh volatile solvent. The web 1 should be spaced from the image substrate 20 a distance appropriate to enable the effective fixing of the toner image by the vapors of the volatile liquid solvent. Appropriate spacing and the speed of the web and the toner image are interdependent factors that depend on the particular solvent employed. It has been found desirable, in general, to maintain a distance of about one to several millimeters between said web 1 and image substrate 20 in the fixing zone between the rollers 6 and 6'.

Figure 2:
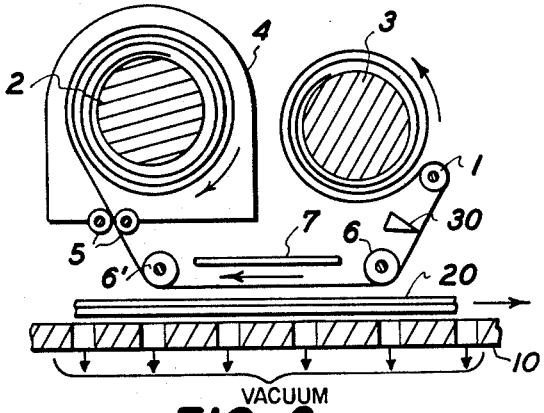
FIG. 2 is a schematic illustration of another embodiment of the present invention, wherein the web is wetted with the fixing solvent after it is removed from the supply roll, and only the receiving roll is disposed in a housing.

The embodiment of the invention shown in FIG. 2 is very similar to that shown in FIG. 1, and corresponding parts have been similarly designated. In FIG. 2, web 1 on supply roll 3 is not prewetted with fixing solvent, but instead the solvent is supplied from a nozzle 30. The nozzle 30 extends transversely across the entire web 1, thereby substantially covering the entire width of the web with solvent. In this embodiment, the fixing solvent may be intermittently supplied to the web as needed by detecting the advance of toner images and the progress of the fixing operation, i.e. the effectiveness of the fixing operation. Thus, the time at which the fixing solvent is supplied from the nozzle 30 to the fixing web 1 and the quantity of the fixing solvent supplied may be adjusted depending upon the fixing requirements observed. After being conveyed through the fixing zone between guide rolls 6 and 6', the web 1 carrying residual fixing solvent is taken into a vapor tight housing 4 onto receiving roll 2. Resilient seals 5 define a vapor tight inlet to the housing 4, and they may be designed to compensate for increases in pressure inside the housing due to changes in temperature or other causes, by making at least one of the seals displaceable and responsive to said increase in pressure. Alternatively, a separate safety valve may be provided to handle any pressure buildup within the housing. A protective shield 7 is advantageously provided in the fixing zone above the web to limit the dispersion of fixing solvent into the environs.

Figure 3:
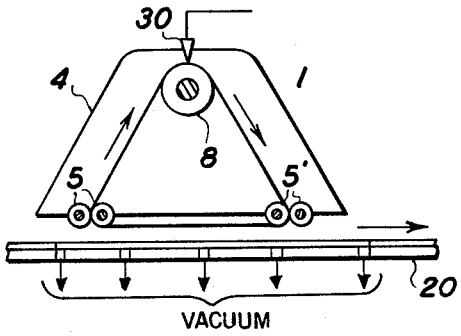
FIG. 3 is a schematic illustration of a further embodiment of the present invention utilizing an endless web that is continually wetted with solvent.

FIG. 3 shows a further embodiment of the apparatus of the present invention in which the web 1 is in the form of an endless belt. This arrangement makes the fixing operation particularly suitable for fixing toner images for an extended or indefinite period of time. The web 1 is continuously conveyed around rollers 8, 5 and 5' and one or more of the rollers may be provided with a drive source. The fixing solvent is supplied from nozzle 30 to the web, as needed. The embodiment of FIG. 3 is also advantageous in that the tension of the web facing the substrate containing the toner image is substantially constant. The entire endless web 1 is contained in the housing 4, except for the portion positioned in juxtaposition to the toner image and its substrate 20. Rolls 5 and 5' function as seals for the egress and ingress of the web from and into the housing 4.

Figure 4A:
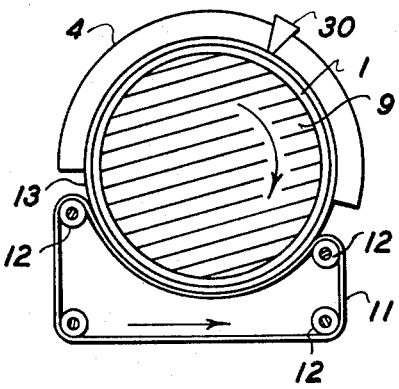
FIGS. 4A and 4B are schematic illustrations of still a further embodiment of the present invention, wherein the porous web material containing the fixing solvent is a sleeve covering a rotatable drum.
Figure 4B:
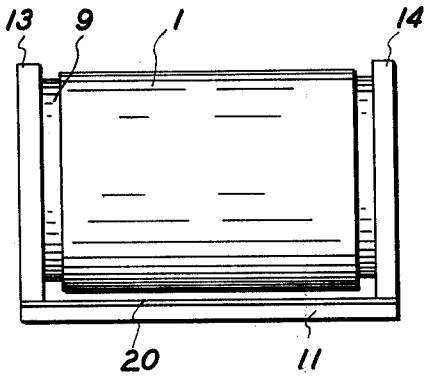

FIGS. 4A and 4B show still a further embodiment of the present invention in which the web 1 is in the form of a sleeve covering a rotatable cylinder 9. The cylinder 9 is provided at its opposite ends with flanges 13 and 14, and the sleeve 1 is located between these flanges. A portion of the surface of the cylinder 9 is enclosed in a housing 4, and the inlet and outlet of the housing may be provided with resilient seals (not shown) to prevent solvent supplied from nozzle 30 to the web 1 from leaking to the outside environment. The substrate 20 containing the toner image is carried by an endless conveyor belt 11 which is positioned to engage the cylinder flanges 13 and 14 outside said housing. Opposite marginal portions of the toner image substrate are received between said conveyer belt and said flanges, and the toner image is thus conveyed in close juxtaposition to the solvent wetted sleeve 1 for the period of conjoint traverse of cylinder 9 and belt 11. The conveyor belt is provided with rollers 12 for driving and guiding said belt.

In the embodiments of FIGS. 3 and 4, if image substrates 20 are not continuously introduced into the apparatus, continuous feeding of fixing solvent to the web 1 is wasteful. Such waste may be substantially eliminated by controlling the feed of the fixing solvent from nozzle 30 in accordance with the need therefor.

Figure 5:
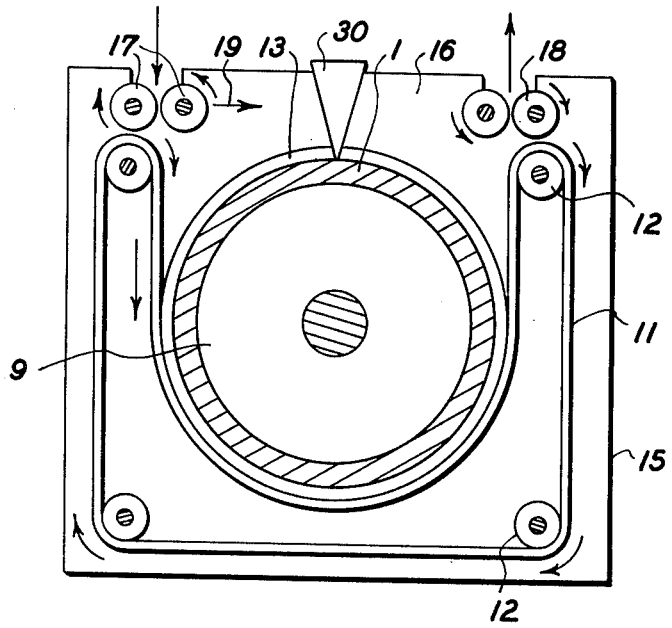
FIGS. 5 and 6 are schematic illustrations of additional embodiments of the present invention, wherein the solvent carrying web is completely enclosed within a sealed housing.

FIG. 5 shows an embodiment of the apparatus of the present invention wherein the fixing solvent systems is completely sealed from the environs. In this embodiment, similar to the embodiment of FIG. 4, the solvent carrying web 1 is in the form of a sleeve covering a rotatable drum or cylinder 9, said cylinder being provided at its opposite ends with end flanges 13 and 14 to maintain the toner image being conveyed around a portion of the cylinder a fixed distance from said sleeve. An endless conveyer belt 11 is positioned to engage the flanges 13 and 14 over a portion of the circumference of the cylinder, for receiving marginal edge portions of the toner image substrate between said conveyor belt and said flanges. The conveyer belt is passed around rollers 12 which guide the belt along the flanges 13 and 14 at the opposite ends of the cylinder 9. At least some of the rollers 12 are externally powered to drive the conveyor belt together with the substrate containing the toner image in the direction of the arrows. A housing defined by elements 15 and 16 is provided to enclose the cylinder and conveyor belt completely. Fixing solvent is supplied to web 1 by nozzle 30.

The inlet and outlet for the introduction of the substrate containing the toner image into the housing and its removal from the housing are provided at the top of the apparatus. This positioning of the inlet and outlet is effective in preventing the solvent vapor from leaking to the outside environment since the specific gravity of the solvent vapor is usually greater than that of air. In any event, the inlet and outlet for the substrate are provided with input and output rollers 17 and 18, respectively, which seal the inside of the housing from the outside environment. If there is a possibility that the toner image could be damaged by contact with rollers 17, one of these rollers may be mounted to be displaceable in the direction of arrow 19, so that a slight gap may be provided between the image surface and the roller as the substrate passes through the inlet into the housing. Even when this slight gap is utilized, solvent vapor will not leak to the outside environment in significant quantities, since the vapor is heavier than air. At the outlet of the apparatus the image will not be adversely affected when it is pinched between the rollers 18, because at this point the image has been fixed.

Figure 6:
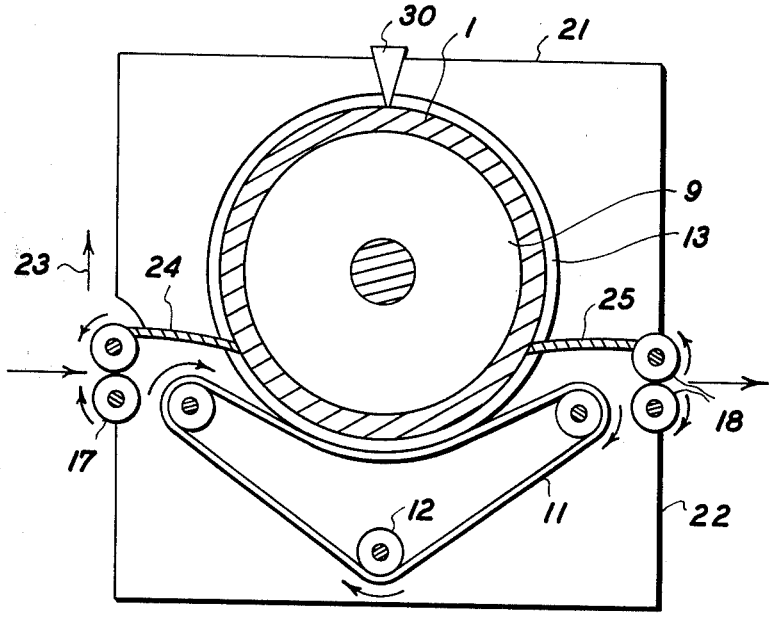

FIG. 6 shows still another embodiment of the apparatus of the present invention, and provides a complete housing enclosure with horizontal feed of the toner image instead of the vertical feed of FIG. 5. In the embodiment of FIG. 6, the web 1, which is wetted with the fixing solvent by nozzle 30, is again in the form of a sleeve covering the surface of rotatable drum or cylinder 9. As in the case of the embodiments of FIGS. 4 and 5, the cylinder is provided at its opposite ends with flanges 13 and 14 having a larger diameter than that of the cylinder 9 to space the toner image surface from sleeve 1. The endless conveyer belt 11 is positioned to engage said flanges over a portion of the circumference of the cylinder for receiving opposite marginal edge portions of the toner image substrate therebetween. The entire apparatus is accommodated within the upper and lower halves 21 and 22 of a housing. The inlet and outlet of the housing is provided with resilient rollers 17 and 18 to seal the inside of the housing from the outside environment. The upper roller of the inlet rollers 17 is shown as being displaceable in the direction of the arrow 23, so that it can be adjusted so as not to touch the toner image to be fixed. Each of resilient members 24 and 25 contacts web 1 and one of each of the pairs of inlet and outlet rollers 17 and 18, respectively, thereby dividing the space defined by the upper and lower housing halves 21 and 22 into upper and lower portions. This division of the housing enclosure further minimizes escape of solvent vapor to the environs through the inlet and outlet rolls 17, 18.

In the embodiment of FIGS. 4–6, the solvent laden sleeve 1 and the rotating cylinder 9 may be driven in the same direction and at the same speed as the conveyer belt 11. However, similar to the embodiments of FIGS. 1 t0 3, it is possible to convey the belt 11 and image substrate in the opposite direction from the sleeve or web 1, by separately driving the body of the cylinder 9 and the larger diameter flanges 13, 14 at the ends of the cylinder body in opposite directions, so that the flanges 13, 14 move in unison with the belt holding the substrate. Such an arrangement tends to improve the overall efficiency of the apparatus by providing countercurrent type of operation. In any one of the embodiments of the present invention, there is always the possibility that solvent vapor may tend to leak through the inlet and/or outlet of the housing. Accordingly, one may provide an exhaust system in the vicinity of the inlet and/or outlet to remove such vapor and prevent it from contaminating the surrounding environment.

The invention being thus described, it will be obvious to one skilled in the art that the same may be varied in many ways. Such variations are not to be regarded as departures from the spirit and scope of the invention, and all modifications as are embraced by the spirit and scope of the appended claims are contemplated as within the purview of the present invention.

What is claimed is:

1. Apparatus for the solvent vapor fixing of toner images, comprising a web formed of absorbent material, means for traversing said web over a predetermined path, a first roll for storing a supply of said web material, a second roll for receiving said web material after traversing said path, means for wetting said web with solvent during said traversing, means for locating a toner image in closely spaced juxtaposition to said web over a portion of said predetermined path, means for guiding said web material over said portion of said predetermined path, means for wetting said web with said solvent in its traverse from said first roll to said guiding means, said web being wet with a volatile solvent for said toner during its traverse over said portion of said path, and a housing containing said web material when wet with solvent, said second roll being located within said housing, and said first roll and guiding means being outside said housing, whereby a toner image is fixed by solvent vapors emanating from said web material during the passage of the toner image past said portion of said web material path.

2. The apparatus as set forth in claim 1, wherein the locating means comprises a conveyer belt, said conveyer belt being disposed substantially parallel to the surface of the web over said portion of said path.

3. The apparatus as set forth in claim 2, and further including vacuum means for holding a substrate containing said toner image to said conveyer belt.

4. The apparatus as set forth in claim 1, wherein a protective shield is disposed above the web for limiting the dispersion of the evaporating fixing solvent disposed on the web.

* * * * *